US010443902B2

(12) United States Patent
Lim et al.

(10) Patent No.: US 10,443,902 B2
(45) Date of Patent: Oct. 15, 2019

(54) OUTDOOR DEVICE FOR AN AIR CONDITIONER

(71) Applicant: LG ELECTRONICS INC., Seoul (KR)

(72) Inventors: Hyunjun Lim, Seoul (KR); Hoki Lee, Seoul (KR); Jonghwan Jeung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 372 days.

(21) Appl. No.: 14/856,773

(22) Filed: Sep. 17, 2015

(65) Prior Publication Data

US 2016/0178248 A1 Jun. 23, 2016

(30) Foreign Application Priority Data

Dec. 17, 2014 (KR) ..... 10-2014-0182090

(51) Int. Cl.

| | |
|---|---|
| ***F25B 13/00*** | (2006.01) |
| ***F24F 13/22*** | (2006.01) |
| ***F24F 1/50*** | (2011.01) |
| ***F24F 1/56*** | (2011.01) |

(52) U.S. Cl.

CPC ..... *F25B 13/00* (2013.01); *F24F 1/50* (2013.01); *F24F 1/56* (2013.01); *F24F 13/22* (2013.01)

(58) Field of Classification Search

CPC ..... F24F 1/56; F24F 13/22; F24F 1/50; F25B 13/00

USPC ..... 62/498, 297

See application file for complete search history.

(56) References Cited

U.S. PATENT DOCUMENTS

| | | | | |
|---|---|---|---|---|
| 4,309,365 | A | 1/1982 | Van Ness et al. | |
| 7,971,448 | B2 * | 7/2011 | Kim | F04D 29/541 62/285 |
| 2005/0150247 | A1 | 7/2005 | Ishihara et al. | |
| 2005/0172656 | A1 * | 8/2005 | Jung | F24F 1/26 62/324.1 |
| 2009/0107161 | A1 * | 4/2009 | Jang | F24F 1/26 62/259.1 |

(Continued)

FOREIGN PATENT DOCUMENTS

| | | |
|---|---|---|
| CN | 2503405 | 7/2002 |
| CN | 101586869 | 11/2009 |

(Continued)

OTHER PUBLICATIONS

European Search Report dated Apr. 15, 2016 issued in Application No. 15195217.3.

(Continued)

*Primary Examiner* — Brian M King
(74) *Attorney, Agent, or Firm* — Ked & Associates LLP

(57) ABSTRACT

An outdoor device for an air conditioner is provided. The outdoor device may include a cabinet, and a base provided on or at a lower portion of the cabinet. The base may include a base body, on which at least one first seat that supports a first component may be provided, an edge portion provided along a circumference of the base body and on which at least one second seat that supports a second component may be provided, and at least one connection portion that connects the at least one first seat to the at least one second seat.

14 Claims, 7 Drawing Sheets

(56) References Cited

U.S. PATENT DOCUMENTS

| | | | | |
|---|---|---|---|---|
| 2010/0116461 | A1* | 5/2010 | Saito | F24F 1/30 165/62 |
| 2010/0175407 | A1 | 7/2010 | Kim et al. | |
| 2013/0205823 | A1* | 8/2013 | Yagyu | F24F 1/18 62/324.5 |
| 2014/0131024 | A1* | 5/2014 | Iwazaki | F24F 13/222 165/185 |
| 2014/0298844 | A1* | 10/2014 | Luo | F24F 1/36 62/275 |
| 2014/0338384 | A1 | 11/2014 | Koike | |
| 2015/0000321 | A1 | 1/2015 | Kagawa et al. | |
| 2016/0076779 | A1* | 3/2016 | Lee | F24F 1/36 62/508 |
| 2016/0076796 | A1* | 3/2016 | Lee | F25B 13/00 62/498 |

FOREIGN PATENT DOCUMENTS

| | | | |
|---|---|---|---|
| CN | 201348317 | | 11/2009 |
| CN | 101726047 | | 6/2010 |
| CN | 101737868 | | 6/2010 |
| CN | 201724366 | | 1/2011 |
| CN | 103822313 | | 5/2014 |
| CN | 102538086 | B | 6/2014 |
| CN | 103917829 | | 7/2014 |
| CN | 103988026 | A | 8/2014 |
| CN | 203823946 | | 9/2014 |
| CN | 105423452 | | 3/2016 |
| EP | 2 037 187 | | 3/2009 |
| EP | 2 159 497 | | 3/2010 |
| EP | 2 180 267 | | 4/2010 |
| EP | 2184549 | A2 | 5/2010 |
| EP | 2 206 976 | | 7/2010 |
| EP | 2 738 476 | | 4/2014 |
| EP | 2 733 435 | A2 | 5/2014 |
| EP | 2 995 873 | | 3/2016 |
| JP | H 10-300131 | | 11/1998 |
| JP | H 11-264584 | | 9/1999 |
| JP | 2000-130800 | A | 5/2000 |
| JP | 2010-261712 | A | 11/2010 |
| JP | 2012-242026 | A | 12/2012 |
| JP | 2013-050265 | | 3/2013 |
| JP | 2013-113513 | A | 6/2013 |
| JP | 2014-105954 | | 6/2014 |
| KR | 10-2006-0083016 | | 7/2006 |
| KR | 10-2008-0056478 | | 6/2008 |
| KR | 10-2009-0040498 | A | 4/2009 |
| KR | 10-2009-0044504 | | 5/2009 |
| KR | 10-1401876 | A | 5/2014 |
| KR | 10-2014-0088625 | A | 7/2014 |
| KR | 10-2014-0093755 | A | 7/2014 |
| KR | 10-2014-0094648 | A | 7/2014 |
| WO | WO 2011/027709 | A1 | 3/2011 |
| WO | WO 2011/052318 | A1 | 5/2011 |
| WO | WO 2013/080760 | A1 | 6/2013 |
| WO | WO 2013/088713 | A1 | 6/2013 |

OTHER PUBLICATIONS

European Search Report dated Feb. 18, 2016 issued in Application No. 15184028.7.

Korean Office Action dated Mar. 18, 2016 issued in Application No. 10-2014-0120978.

Korean Office Action dated Mar. 18, 2016 issued in Application No. 10-2014-0120979.

Korean Office Action dated Apr. 1, 2016 issued in Application No. 10-2015-0048237.

Korean Office Action dated Apr. 1, 2016 issued in Application No. 10-2015-0066090.

European Search Report dated Apr. 5, 2016 issued in Application No. 15184052.7.

Korean Notice of Allowance dated Jun. 23, 2017.

U.S. Office Action issued in U.S. Appl. No. 14/851,105 dated Sep. 20, 2017.

European Search Report dated Jun. 23, 2016 issued in Application No. 15 19 5183.7.

United States Office Action dated May 19, 2017, issued in co-pending U.S. Appl. No. 14/849,043.

United States Office Action dated Jan. 12, 2018, issued in co-pending U.S. Appl. No. 14/850,248.

Chinese Office Action dated Nov. 3, 2017 issued in Application No. 201510388473.8 (with English Translation).

Chinese Office Action dated Feb. 1, 2018 (English Translation).

Chinese Office Action dated Aug. 20, 2018 with English Translation.

United States Office Action dated Apr. 7, 2017, issued in co-pending U.S. Appl. No. 14/851,105.

* cited by examiner

OUTDOOR DEVICE FOR AN AIR CONDITIONER

CROSS-REFERENCE TO RELATED APPLICATION(S)

The present application claims priority under 35 U.S.C. 119 and 35 U.S.C. 365 to Korean Patent Application No. 10-2014-0182090, filed in Korea on Dec. 17, 2014, which is hereby incorporated by reference in its entirety.

BACKGROUND

1. Field

An outdoor device for an air conditioner is disclosed herein.

2. Background

Air conditioners are apparatuses for maintaining air in a predetermined space in a most suitable state according to their use and purpose. In general, such an air conditioner drives a refrigeration cycle in which compression, condensation, expansion, and evaporation processes of a refrigerant are performed to cool or heat a predetermined space.

The predetermined space may be various spaces in which the air conditioner is used. For example, when the air conditioner is located in houses or offices, the predetermined space may be an indoor space of a house or building. On the other hand, when the air conditioner is located in a vehicle, the predetermined space may be a passenger boarding space.

When the air conditioner performs a cooling operation, an outdoor heat exchanger provided in an outdoor unit or device may function as a condenser, and an indoor heat exchanger provided in an indoor unit or device may function as an evaporator. On the other hand, when the air conditioner performs a heating operation, the indoor heat exchanger may function as the condenser, and the outdoor heat exchanger may function as the evaporator.

The outdoor device of the air conditioner may include a base that defines a lower outer appearance of the outdoor device. The present Applicant has applied for and registered Korea Patent Registration No. KR10-1401876 (hereinafter referred to as "related art document"), filed in Korea on May 23, 2014 and entitled "Base Assembly of Outdoor Unit of Air Conditioner", in which a base of an outdoor device is disclosed and which is hereby incorporated by reference. However, in the base of the outdoor device of the air conditioner according to the related art document, the base may droop downward or be damaged due to weights of a plurality of components provided on the base, for example, one or more compressor, a gas-liquid separator, one or more oil separator, and a tube. To solve this limitation, the base may be increased in thickness; however, in this case, the base may increase in material cost and weight.

BRIEF DESCRIPTION OF THE DRAWINGS

Embodiments will be described in detail with reference to the following drawings in which like reference numerals refer to like elements, and wherein.

DETAILED DESCRIPTION

Figure 1:
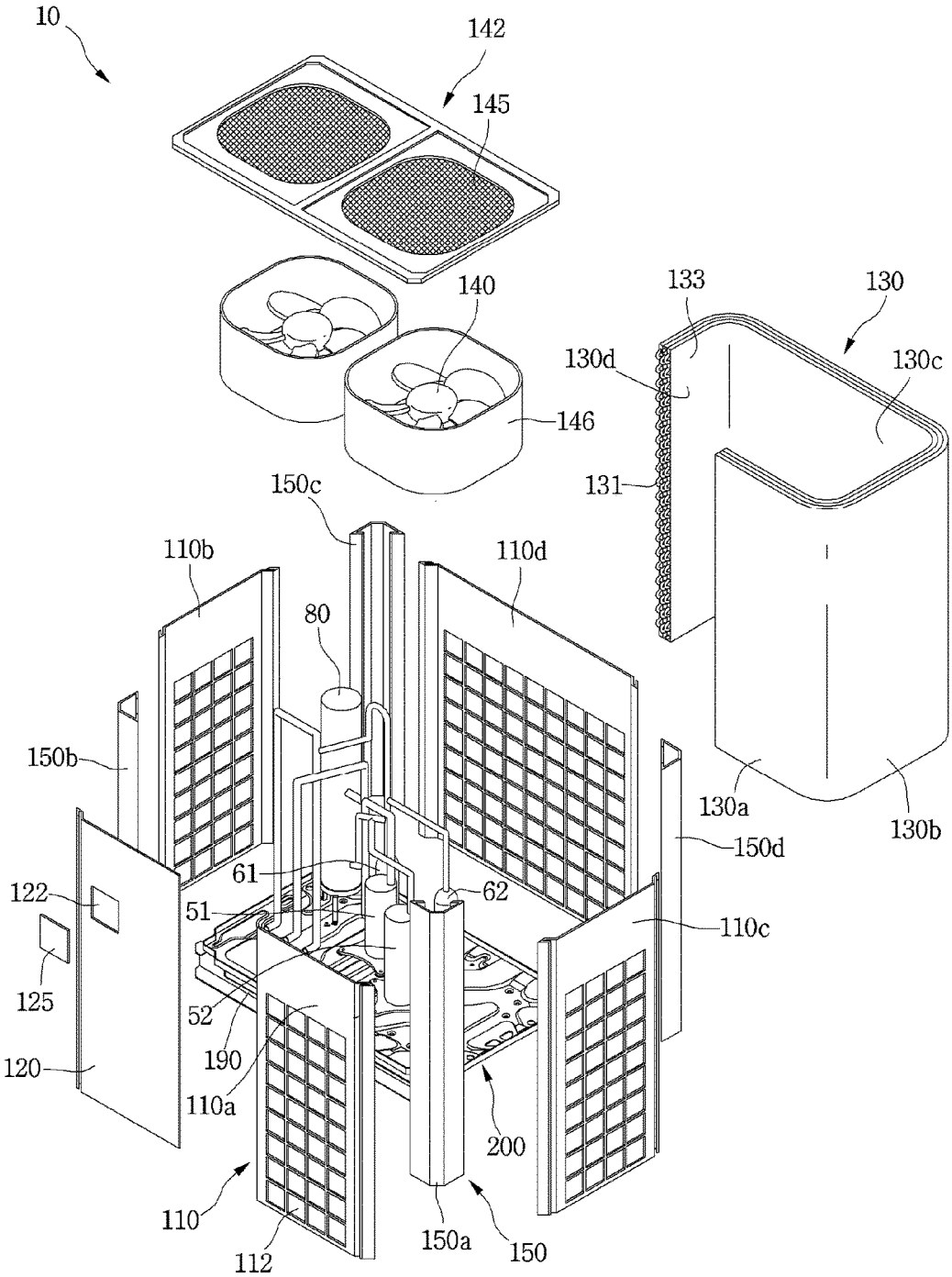
FIG. 1 is an exploded perspective view of an outdoor device for an air conditioner according to an embodiment.
Figure 2:
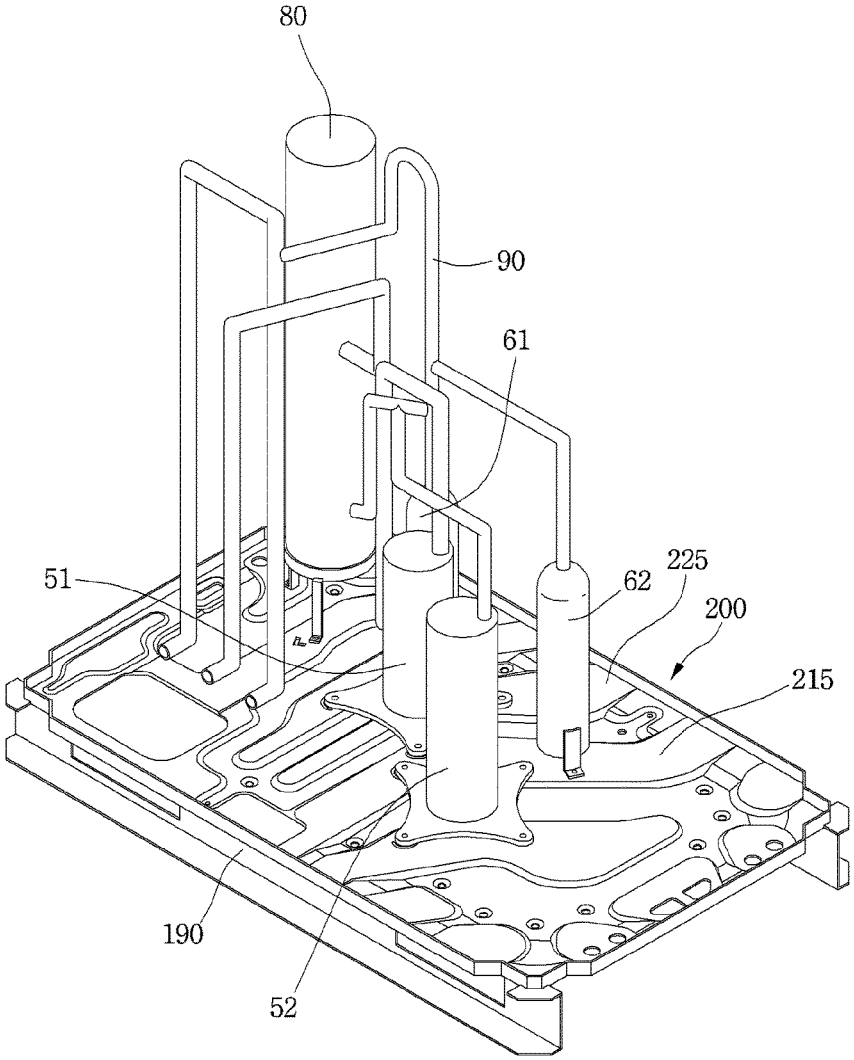
FIG. 2 is a perspective view illustrating a state in which a plurality of components is provided on a base of the outdoor device of FIG. 1.

FIG. 1 is an exploded perspective view of an outdoor device for an air conditioner according to an embodiment. FIG. 2 is a perspective view illustrating a state in which a plurality of components is provided on a base of the outdoor device of FIG. 1.

Referring to FIGS. 1 and 2, an outdoor device 10 of an air conditioner according to an embodiment may include a base 200 that defines a lower outer appearance of the outdoor device 10 and that supports a plurality of components provided in the outdoor device 10, legs 190 provided on or at a lower portion of the base 200 to allow the outdoor device 10 to be supported at or in an installation space, and a cabinet 110, 120, and 150 provided on an upper portion of the base 200.

The plurality of legs 190 may be provided on both sides of the lower portion of the base 200 and then placed on or in the installation space, for example, on the ground. The base 200 may have a plate shape including two long sides and two short sides, for example. The plurality of legs 190 may be provided on a lower side of each of the two long sides of the base 200. For example, the base 200 may have a rectangular shape.

The cabinet 110, 120, and 150 may include a suction panel 110. A plurality of the suction panel 110 may be provided, and the plurality of suction panels 110 may be provided along a circumference of the base 200. That is, the plurality of suction panels 110 may be provided to extend in an upward direction from an edge of the base 200.

For example, the plurality of suction panels 110 may be provided on first, second, third, and fourth sides of the base 200, for example, front and rear sides, and left and right sides. The plurality of suction panels 110 may include a plurality of suction grills 112, through which outdoor air may be introduced into the outdoor device 10. The outdoor air may be introduced into the outdoor device 10 through the plurality of suction panels 110 from the front and rear sides or left and right sides of the outdoor device 10, for example.

The cabinet 110, 120, and 150 may include a control panel 120. The control panel 120 may be a door openable to provide access to a control box (not shown) provided in the outdoor device 10. For example, the control panel 120 may be rotatably or slidably provided. The control panel 120 may be provided on or at a lateral side of a suction panel 110 provided at a front side of the outdoor device 10 of the plurality of suction panels 110, for example.

A direction of the outdoor device 10 may be defined as follows.

A surface on which the control panel 120 is provided may be referred to as a "front surface" of the outdoor device 10. Surfaces provided at both lateral sides of the front surface of the outdoor device 10 may be referred to as "both side surfaces", or "left/right surfaces". A surface provided opposite to the front surface of the outdoor device 10 may be referred to as a "rear surface".

The outdoor device 10 may include the control panel 120 and a first suction panel 110*a* provided at a lateral side of the control panel 120 on the front surface thereof. The outdoor device 10 may include a second suction panel 110*b* provided to extend in a direction perpendicular to the control panel 120 on a left surface thereof. The outdoor device 10 may include a third suction panel 110*c* provided to extend in a direction perpendicular to the first suction panel 110*a* on a right surface thereof. The outdoor device 10 may include a fourth suction panel 110*d* provided to extend in a direction perpendicular to the left/right surfaces thereof.

The control panel 120 may include a viewing window 122 through which a display of the control box may be viewable, and a cover member 125 that provides for selective opening of the viewing window 122.

The cabinet 110, 120, and 150 may include a plurality of brackets 150 that supports the plurality of suction panels 110 and the control panel 120. The plurality of brackets 150 may extend in the upward direction from the base 200.

The plurality of brackets 150 may include a first bracket 150*a* provided between the first suction panel 110*a* and the third suction panel 110*c* provided adjacent to the first suction panel 110*a* to support the first and third suction panels 110*a* and 110*c*. The first and third suction panels 110*a* and 110*c* may be coupled to both sides of the first bracket 150*a*.

The plurality of brackets 150 may further include a second bracket 150*b* provided between the second suction panel 110*b* and the control panel 120 provided adjacent to the second suction panel 110*b* to support the second suction panel 110*b* and the control panel 120. The second suction panel 110*b* and the control panel 120 may be coupled to both sides of the second bracket 150*b*.

The plurality of brackets 150 may further include a third bracket 150*c* provided between the second suction panel 110*b* and the fourth suction panel 110*d* to support the second and fourth suction panels 110*b* and 110*d*. The second and fourth suction panels may be coupled to both sides of the third bracket 150.

The plurality of brackets 150 may further include a fourth bracket 150*d* provided between the third and fourth suction panels 110*c* and 110*d* to support the third and fourth suction panels 110*c* and 110*d*. The third and fourth suction panels 110*c* and 110*d* may be coupled to both sides of the fourth bracket 150*d*.

A heat exchanger 130 may be provided in the outdoor device 10. The heat exchanger 130 may extend along inner surfaces of the cabinet 110, 120, and 150. That is, the heat exchanger 130 may be bent several times to extend along inner surfaces of the plurality of suction panels 110. Also, the heat exchanger 130 may be seated on or along an edge that defines a long side of the base 200 and an edge that defines a short side of the base 200.

The heat exchanger 130 may include four surfaces. The four surfaces include a first surface 130*a* that faces the front surface of the outdoor device 10 and seated on or along one edge that defines one long side of the base 200, a second surface 130*b* that faces the left surface of the outdoor device 10 and seated on or along one edge that defines one short side of the base 200, a third surface 130*c* that faces the right surface of the outdoor device 10 and seated on the other edge that defines the other short side of the base 200, and a fourth surface 130*d* that faces the rear surface of the outdoor device 10 and seated on the other edge that defines the other long side of the base 200.

The heat exchanger 130 may include a heat exchange tube 131 through which a refrigerant may flow, and a plurality of heat exchange fins 133 coupled to the heat exchange tube 131 to assist heat exchange of the refrigerant. The heat exchange tube 131 may form at least a portion of a refrigerant tube 90, and the plurality of heat exchange fins 133 may each provide a surface to exchange heat between the refrigerant and air. The outdoor air introduced through the plurality of suction grills 112 of the plurality of suction panels 110 may be heat-exchanged while passing through the heat exchanger 130.

The outdoor device 10 may further include at least one blower fan 140 to introduce or draw in the outdoor air, and at least one fan housing 146 provided to surround the at least one blower fan 140 to guide a flow of the outdoor air. The outdoor device 10 may further include a discharge panel 142 provided on or at one side of the at least one blower fan 140. The discharge panel 142 may include at least one discharge grill 145, through which the air may be discharged outside of the outdoor device 10.

The at least one blower fan 140 may be provided in an upper portion of the outdoor device 10, and the discharge panel 142 may be provided on or at an upper portion of the at least one blower fan 140. Air passing through the heat exchanger 130 may flow upward to pass through the at least one blower fan 140 and the discharge panel 142, thereby being discharged outside the outdoor device 10.

A plurality of components may be provided on an upper portion of the base 200. The base 200 may include seats 215 and 225, on which the plurality of components may be supported.

The plurality of components may include compressors 51 and 52 that compress the refrigerant, oil separators 61 and 62 provided on or at discharge sides of the compressors 51 and 52 to separate oil contained in the refrigerant, a gas-liquid separator 80 provided on or at an inlet-side of the compressors 51 and 52 to separate a liquid refrigerant and supply a gaseous refrigerant into the compressors 51 and 52, and the refrigerant tube 90 connected to the compressors 51 and 52, the oil separators 61 and 62, and the gas-liquid separator 80 to guide a flow of the refrigerant. The compressors 51 and 52 may include a first compressor 51 and a second compressor 52. The oil separators 61 and 62 may include a first oil separator 61 provided at an outlet-side of the first compressor 51, and a second oil separator 62 provided at an outlet-side of the second compressor 52. The heat exchanger 130 may be provided to surround the compressors 51 and 52, the oil separators 61 and 62, and the gas-liquid separator 80.

Hereinafter, the base will be described with reference to the accompanying drawings.

Figure 3:
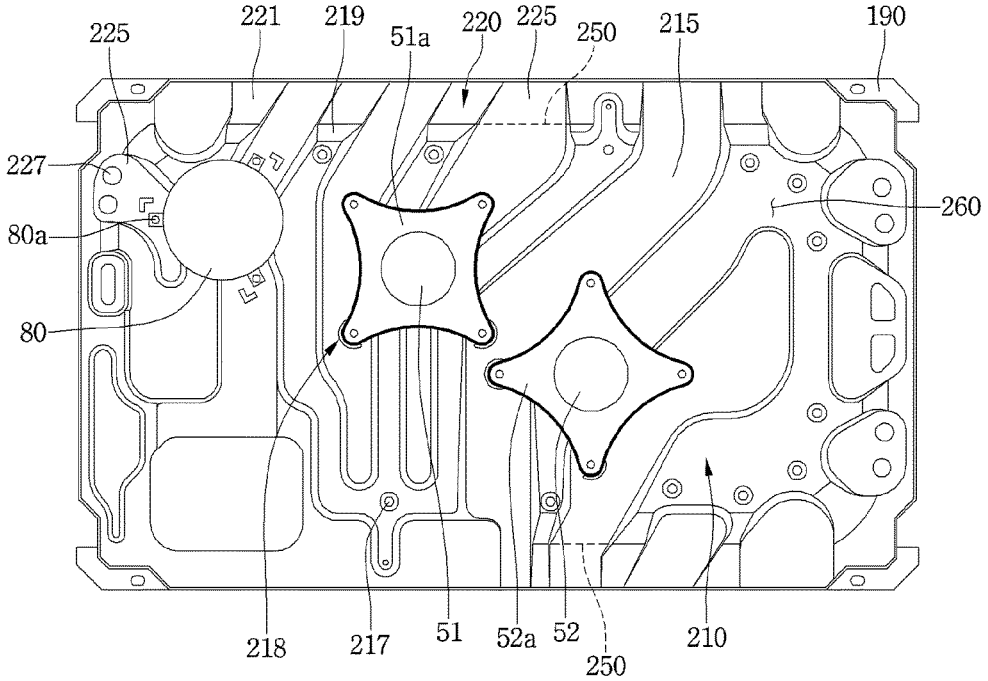
FIG. 3 is a plan view illustrating the state in which the plurality of components is provided on the base of the outdoor device of FIG. 1.
Figure 4:
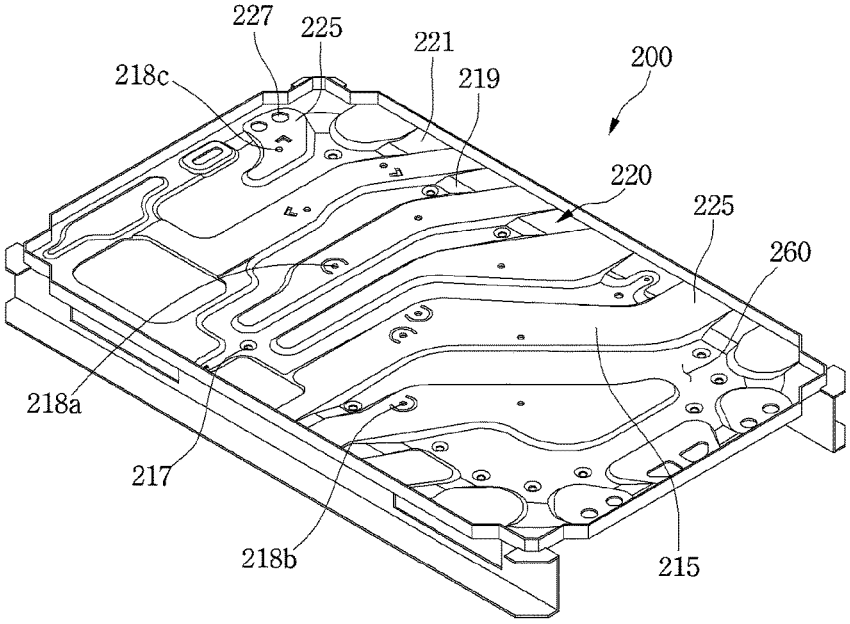
FIG. 4 is a perspective view of the base of the outdoor device of FIG. 1.
Figure 5:
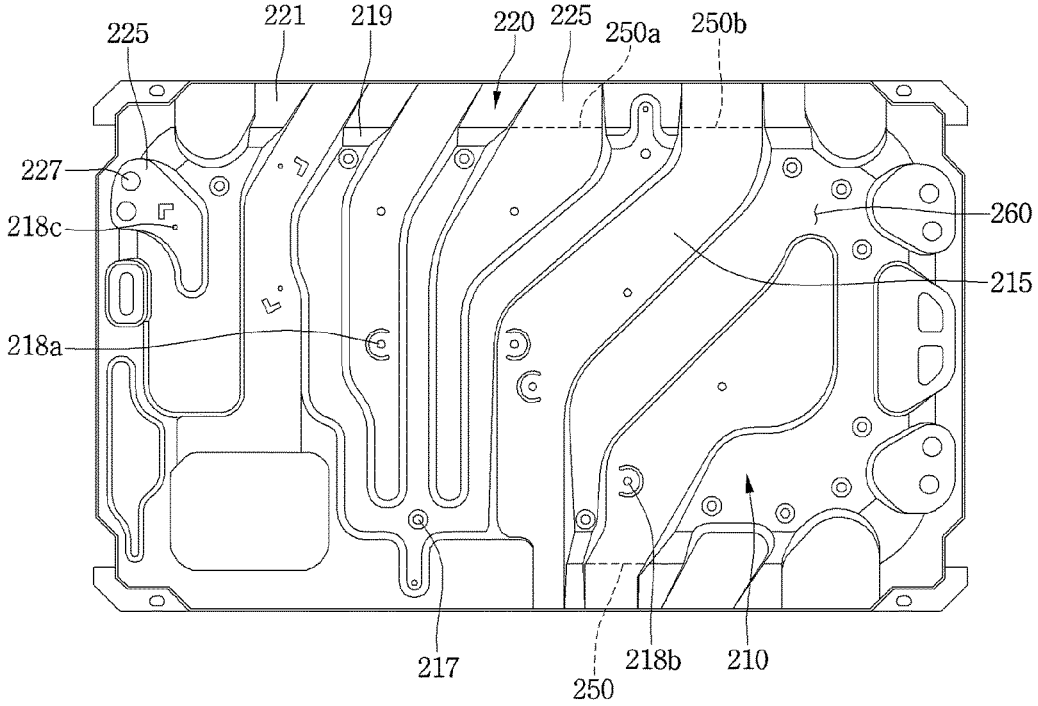
FIG. 5 is a plan view of the base of the outdoor device of FIG. 1.

FIG. 3 is a plan view illustrating a state in which the plurality of components is provided on the base of the outdoor device of FIG. 1. FIG. 4 is a view perspective illustrating the base of the outdoor device of FIG. 1. FIG. 5 is a plan view of the base of the outdoor device of FIG. 1.

Referring to FIGS. 3 to 5, the base 200 of the outdoor device 10 according to an embodiment may include a base body 210 that defines a lower outer appearance thereof, and an edge portion 220 provided on or at an outside of the base body 210. The base 200 may include the seats 215 and 225, on which at least a portion of the plurality of components may be seated.

The seats 215 and 225 may include a first seat 215 provided on the base body 210 and on which first components of the plurality of components may be seated, and a second seat 225 provided on the edge portion 220 and on which a second component of the plurality of components may be seated.

First components, for example, the compressors 51 and 52 and the gas-liquid separator 80 may be supported by the first seat 215. For example, the compressors 51 and 52 and the gas-liquid separator 80 may be coupled to the first seat 215.

To support the first components of the plurality of components, a plurality of the first seat 215 may be provided, and the plurality of the first seats 215 may be spaced apart from each other.

A plurality of coupling holes 218, to which the compressors 51 and 52, and the gas-liquid separator 80 may be coupled, may be defined in the first seat 215. Each of the compressors 51 and 52 and the gas-liquid separator 80 may include a support fixed to the plurality of coupling holes 218 by, for example, a plurality of coupling member.

For example, the supports may include first and second compressor supports 51*a* and 52*a*, respectively, on which the first and second compressors 51 and 52 may be provided, and a gas-liquid separator support 80*a*, on which the gas-liquid separator 80 may be provided.

The plurality of coupling holes 218 may include a plurality of first coupling holes 218*a* defined in or at a position to which the first compression support 51*a* may be coupled. For example, the first compression support 51*a* may be coupled at four spots on the first seat 215. Thus, four first coupling holes 218*a* may be provided, for example.

The plurality of coupling holes 218 may include a plurality of second coupling holes 218*b* defined in or at a position to which the second compression support 52*a* may be coupled. For example, the second compression support 52*a* may be coupled at four spots on the first seat 215. Thus, four second coupling holes 218*b* may be provided, for example.

The plurality of coupling holes 218 may include a plurality of third coupling holes 218*c* defined in or at a position to which the gas-liquid separation support 80*a* may be coupled. For example, the gas-liquid separation support 80*a* may be coupled at three spots on the first seat 215. Thus, three third coupling holes 218*c* may be provided, for example.

Liquid existing in or contained within the outdoor device 10, for example, defrost water from the heat exchanger 130 or water introduced from the outside, such as rainwater, may be contained in the base body 210. The liquid may be discharged to a lower side of the base body 210 through at least one first drain hole 217 defined in the base body 210. Thus, the base body 210 may be referred to as a "drain pan".

The first seat 215 may protrude in the upward direction from the base body 210. As the compressors 51 and 52, the oil separators 61 and 62, and the gas-liquid separator 80 may be supported by the first seat 215, lower portions of each of the compressors 51 and 52, the oil separators 61 and 62, and the gas-liquid separator 80 may be spaced in the upward direction from the base body 210. According to the protruding structure of the first seat 215, the compressors 51 and 52, the oil separators 61 and 62, the gas-liquid separator 80 may not be affected by the fluid existing in or contained within the base body 210.

The edge portion 220 may extend along a circumference of the base body 210 and be stepped in the upward direction from the base body 210. That is, the edge portion 220 may have an upper surface positioned higher than an upper surface of the base body 210. Also, the edge portion 220 may define the two long sides and two short sides of the base 200.

A step (see reference numeral 219 of FIG. 4) that defines a step difference may be provided between the base body 210 and the edge portion 220. The edge portion 220 may be positioned higher than the base body 210 by the step 219.

The edge portion 220 may extend by a predetermined length from the step 219 toward an outside of the base body 210 or in an outward direction. Further, the edge portion 220 may include an edge body 221 having a height higher than a height of the base body 210, and the second seat 225 that protrudes in the upward direction from the edge body 221 to allow the second component of the plurality of components, that is, the heat exchanger 130, to be seated thereon. At least a portion of the second seat 225 may be provided to extend to the base body 210. A plurality of the second seat 225 may be provided, and the plurality of second seats 225 may be spaced apart from each other.

The liquid existing in or contained with the outdoor device 10, for example, defrost water from the heat exchanger 130 or water introduced from the outside, such as rainwater, may be contained in the edge body 221. As the second seat 225 may be spaced in the upward direction from the edge body 221, a lower portion of the heat exchanger 130 may be spaced in the upward direction from the edge body 221. Thus, the heat exchanger 130 may not be affected by the liquid existing in or contained within the edge body 221.

The base 200 may include a plurality of drain holes 217 and 227. The plurality of drain holes 217 and 227 may include a first drain hole 217 defined in the base body 210, and a second drain hole 227 defined in the second seat 225. A plurality of each of the first and second drain holes 217 and 227 may be provided, and the plurality of drain holes 217 and 227 may be spaced apart from each other. According to a height difference between the base body 210, the edge body 221, and the second seat 225, the second discharge hole 227 may be defined higher than the first discharge hole 217.

The edge portion 220 may define the two long sides (first and second long sides) and the two short sides (first and second short sides) of the base 200. The second discharge hole 227 may include a first short side discharge hole 227*a* defined in a portion of the edge portion 220 that defines the first short side of the base 200, and a second short side discharge hole 227*b* defined in a portion of the edge portion 220 that defines the second short side of the base 200. The first short side discharge hole 227*a* may be defined to face the second short side discharge hole 227*b*.

Discharge holes may not be defined in a portion of the edge portion 220 that defines the first long side of the base 200 and a portion of the edge portion 220 that defines the second long side of the base 200. This is because the legs 190 are provided on the portions of the edge portion 220 that define the first and second long sides of the base 200. When the discharge holes are defined in the portions of the edge portion 220 that define the first and second long sides of the base 200, liquid may be blocked by the plurality of legs 190, and thus, may not be easily discharged. Thus, in this embodiment, a discharge hole may be defined only in the second seats 225 provided on the portions of the edge portion 220 that define the first and second short sides of the base 200 to guide discharge of the liquid.

Any one first seat 215 of the plurality of first seats 215 may be connected to any one second seat 225 of the plurality of second seats 225. The base 200 may include a connection portion 250 by which the first seat 215 may be connected to the second seat 225. The connection portion 250 may be referred to as a "boundary" of integrated first and second seats 215 and 225. The first seat 215, the second seat 225, and the connection portion 250 may form one plane. See, for example, FIG. 4. The one first seat 215 may be a seat that supports the first compressor 51 or the second compressor 52, which has a relatively large weight of the first components of the plurality of components.

A plurality of the connection portion 250 may be provided to correspond to the first and second compressors 51 and 52. For example, the plurality of connection portions 250 may include a first connection portion 250*a* that connects any one first seat 215 that supports the first compressor 51 to the any one second seat 225. Also, the plurality of connection portions 250 may include a second connection portion 250*b* that connects another first seat 215 that supports the second compressor 52 to another second seat 225.

The any one first seat 215, the any one second seat 225, and the first connection portion 250*a* may extend in a direction in which the short side of the base 200 extends. Also, another first seat 215, the another second seat 225, and the second connection 250*b* may extend in the direction in which the short side of the base 200 portion extends.

As the above-described connection portion 250 is provided, a load or stress from the first and second compressors 51 and 52 seated on the first seat 215 may be transmitted to the second seat 225 through the connection portion 250. Also, a load or stress from the heat exchanger 130 seated on the second seat 225 may be transmitted to the first seat 215 through the connection portion 250.

Thus, a phenomenon in which the load or stress from the plurality of components is concentrated on or in a certain area of the base 200 may be prevented. As a result, the base 200 may be reinforced in rigidity and may be prevented from being damaged.

The plurality of first seats 215 may be spaced apart from each other. The base 200 may include a separation portion 260 that spaces or separates the plurality of first seats 215. The separation portion 260 may be referred to as a "space" between the plurality of first seats 215. The liquid existing in or contained within the base body 210 may be guided through the separation portion 260, and then, may be discharged to the first drainage hole(s) 217. Thus, the liquid may be smoothly drained from the base 200.

Figure 6A:
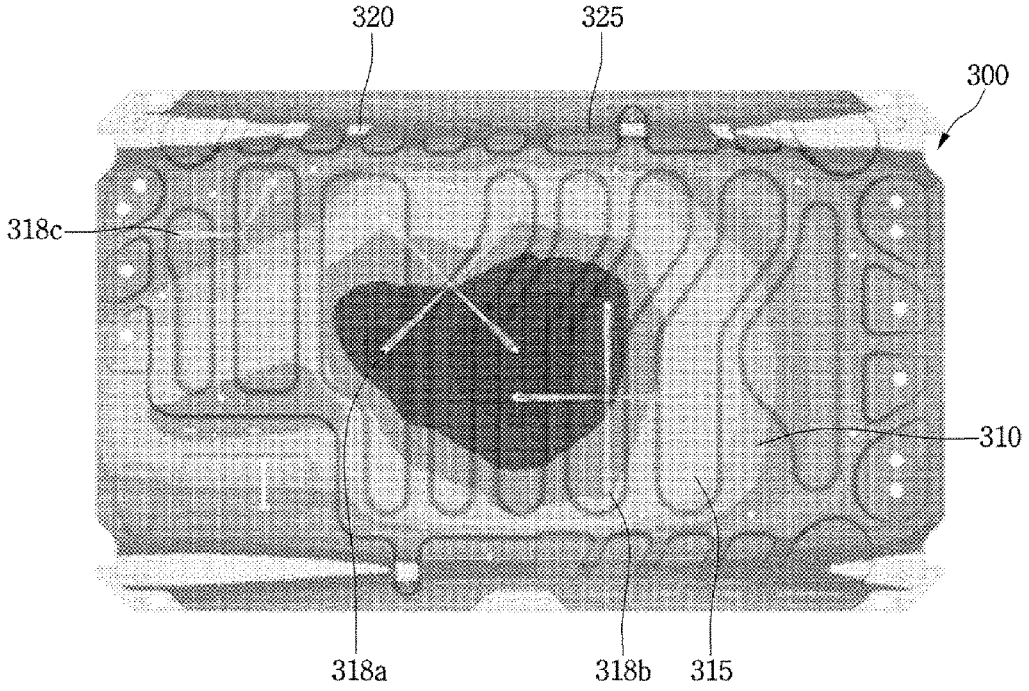
FIG. 6A is a simulation view showing a state in which stress is applied to a base according to a related art.
Figure 6B:
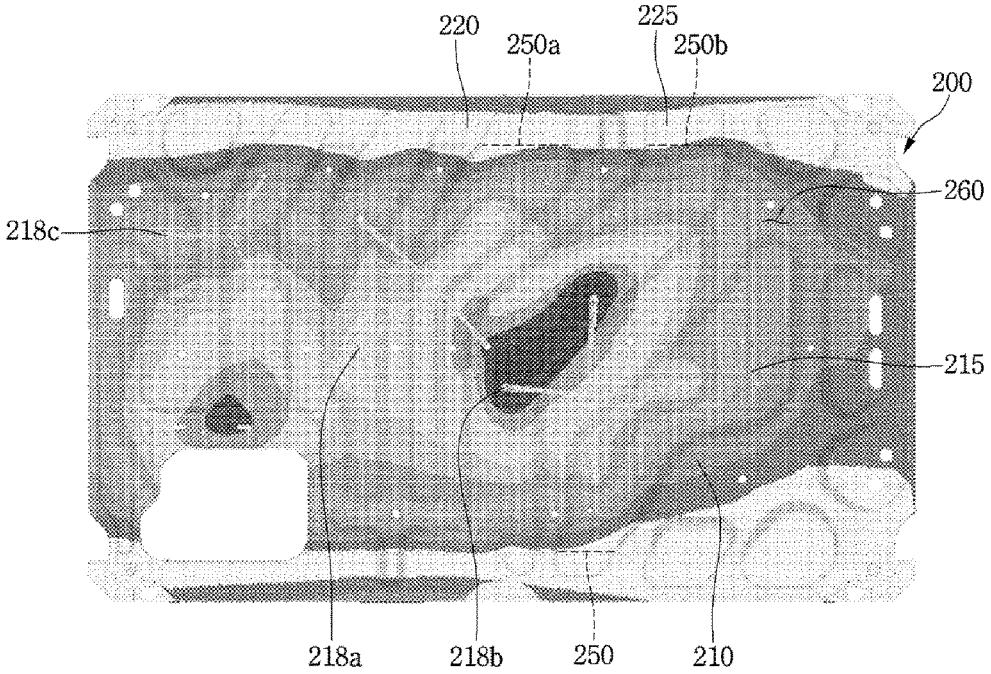
FIG. 6B is a simulation view showing a state in which stress is applied to the base according to an embodiment.

FIG. 6A is a simulation view showing a state in which stress is applied to a base according to a related art. FIG. 6B is a simulation view showing a state in which stress is applied to the base according to an embodiment.

FIG. 6A illustrates a state in which stress is applied to a base 300 by first or second components in the base 300 according to the related art. A first seat 315 of a base body 310 includes a plurality of first coupling holes 318*a*, to which a first compressor support is coupled, a plurality of second coupling holes 318*b*, to which a second compressor support is coupled, and a plurality of third coupling holes 318*c* to which a gas-liquid separator support is coupled. Descriptions with respect to the first and second compressor supports and the gas-liquid separator support were provided with reference to FIG. 5.

As illustrated in FIG. 6A, stress on the first and second compressor supports is very high. A stress value gradually increases toward the darker shading in FIG. 6A. Relatively large stress may be applied to an area or in which the first and second compressors having relatively large loads are provided.

In the base structure according to the related art, as the first seat 315 is spaced apart from second seat 325, the stress applied to the base body 310 is not be transmitted to edge portion 320, but rather, is concentrated in the base body 310. As a result, the base 300 may decrease in rigidity, and thus, may be damaged.

On the other hand, FIG. 6B illustrates a state in which stress is applied to the base 200 by the first or second component in the base 200 according to an embodiment. As illustrated in FIG. 6B, the stress on the first and second compressor supports is relatively low when compared to that of FIG. 6A. That is, the load or stress applied to the first and second compressor supports by the first and second compressors 51 and 52 may be transmitted to the second seat 225 or the edge portion 220 through the connection portion 250.

Thus, the stress may not be concentrated to the base body 210, but rather, may be uniformly dispersed over the base 200. As a result, the base 200 may be reinforced in rigidity, and thus, may be prevented from being damaged.

According to embodiments disclosed herein, the seat that supports the components may be provided on the base to stably support the components. Further, as the first seat provided on the base body is connected to the second seat provided on the edge portion, a phenomenon in which stress by a load of a component is concentrated to the base body or the edge portion may be prevented, and the stress may be uniformly dispersed over the base body and the edge portion.

Furthermore, the separation portion may be defined between the first seat provided on the base body and the second seat provided on the edge portion to allow liquid to flow therethrough, and thus, the liquid may be easily discharged from the base.

Also, in the base having the rectangular shape, the connection portion that connects the first and second seats to each other may extend in the direction in which the short side of the base extends to effectively reinforce the rigidity of the base. Additionally, the legs that support the long sides of the base may be provided on both sides of the lower portion of the base. As the drain hole may be defined in the edge portion surrounding the base body, which extends in the direction in which the short side of the base extends, but is not defined in the edge portion of the long side direction at which the legs are provided, a phenomenon in which flow of liquid is interrupted or blocked by the legs when the liquid is being discharged may be prevented.

Also, as the heat exchanger provided on the edge portion of the base is provided to surround the compressor and the gas-liquid separator provided on the base body, an installation space of the base may be efficiently used.

Embodiments disclosed herein provide an outdoor device for an air conditioner, in which a base may be reinforced in rigidity.

Embodiments disclosed herein provide an outdoor unit or device for an air conditioner that may include suction panels that define a front surface, both side surfaces, and a rear surface of the outdoor unit; a heat exchanger disposed inside of the suction panels and bent to extend along four surfaces of the suction panels; and a base disposed on lower portions of the suction panels, the base having two long sides corresponding to the front and rear surfaces and two short sides corresponding to the both side surfaces. The base may include a first seat part or seat having a coupling hole, to which a compressor and a gas-liquid separator may be coupled; a second seat part or seat on which the heat exchanger may be disposed, the second seat part being disposed along the two long sides and two short sides of the base; and a connection part or portion that connects the first seat part to the second seat part. Each of the first seat part, the connection part, and the second seat part may extend in a predetermined direction. The predetermined direction may correspond to a direction in which the short sides of the base are disposed. A plurality of each of the first and second seat parts may be provided, and the connection part may connect one of the plurality of first seat parts to one of the plurality of second seat parts.

The heat exchanger may be disposed to surround the compressor and the gas-liquid separator. The compressor may include a first compressor and a second compressor, and a plurality of the connection part may be provided to correspond to the first and second compressors.

The plurality of connection parts may include a first connection part or portion that connects one first seat part that supports the first compressor to one second seat part; and a second connection part or portion that connects the other first seat part that supports the second compressor to the other second seat part. The plurality of first seat parts may be spaced apart from each other.

The base may include a separation part or portion that spaces the other one of the plurality of first seat parts from the other one of the plurality of second seat parts. The base may further include a first drain hole, through which a fluid guided through the separation part may be discharged. The second seat part may include a second drain hole, through which a fluid may be discharged.

The outdoor unit may further include legs disposed on a lower portion of the base where the two long sides are defined. The second drain hole may be defined in the second seat part disposed on a portion of the base where the two short sides are defined.

The base may further include a base body on which the first seat part may be disposed; an edge part or edge disposed along a circumference of the base body and on which the second seat part may be disposed; and a stepped part or step that extends upward from the base body toward the edge part.

Embodiments disclosed herein provide an outdoor unit or device for an air conditioner that may include a cabinet; and a base disposed on a lower portion of the cabinet, the base having a rectangular plate having two long sides and two short sides. The base may include a base body, on which a first seat part having a coupling hole to which a compressor may be coupled, may be disposed; an edge part or edge disposed to surround the base body and on which a second seat part or seat that supports the heat exchanger having four surfaces may be disposed; and a stepped part or step that extends upward from the base body toward the edge part. The first seat part may extend to the second seat part in a direction in which the short sides of the base are disposed to transmit stress applied to the base body to the edge part.

The first seat part and the second seat part may be integrated with each other. Each of the first and second seat parts may be provided in plurality, and at least one of the plurality of first seat parts may be connected to at least one of the plurality of second seat parts. The other one of the plurality of first seat parts may be spaced apart from the other one of the plurality of second seat parts.

Embodiments disclosed herein provide an outdoor unit or device for an air conditioner that may include suction panels that defines a front surface, both side surfaces, and a rear surface of the outdoor unit; a heat exchanger disposed inside of the suction panels and bent to extend along four surfaces of the suction panels; and a base disposed on lower portions of the suction panels, the base having two long sides corresponding to the front and rear surfaces and two short sides corresponding to the both side surfaces. The base may include a first seat part or seat having a coupling hole to which a compressor and a gas-liquid separator may be coupled; a second seat part or seat, on which the heat exchanger may be disposed, the second seat part being disposed along the two long sides and two short sides of the base; and a drain hole defined in the second seat part disposed along each of the two short sides to guide drainage.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor device for an air conditioner, the outdoor device comprising:

a plurality of suction panels that defines a front surface, side surfaces, and a rear surface of the outdoor device, respectively;

a heat exchanger provided inside of the plurality of suction panels and bent to extend along four surfaces of the plurality of suction panels;

a base provided at lower portions of the plurality of suction panels, the base having two first sides corresponding to the front and rear surfaces and two second sides corresponding to the side surfaces;

a plurality of brackets that is disposed between the plurality of suction panels and extends in an upward direction from the base; and a leg provided on a lower portion of the base, wherein the base includes:

a base body;

an edge portion provided along a circumference of the base, the edge portion including an edge body having a height higher than a height of the base body;

a step that extends in an upward direction from the base body toward the edge body;

at least one first seat to which at least one compressor and a gas-liquid separator are coupled, the at least one first seat being provided on the base body;

at least one second seat that protrudes in the upward direction from the edge body, and on which the heat exchanger is provided, wherein the at least one second seat is provided along the two first sides and the two second sides of the base; and at least one connection portion that connects the at least one first seat to the at least one second seat, and wherein the at least one connection portion defines a boundary of the integrated at least one first seat and at least one second seat.

2. The outdoor device according to claim 1, wherein each of the at least one first seat, the at least one connection portion, and the at least one second seat extends in a direction along which the two second sides of the base extend.

3. The outdoor device according to claim 1, wherein the at least one first seat and the at least one second seat includes a plurality of first seats and a plurality of second seats, respectively, and wherein the at least one connection portion includes a plurality of connection portions that each connects one of the plurality of first seats to one of the plurality of second seats.

4. The outdoor device according to claim 3, wherein the plurality of first seats is spaced apart from each other.

5. The outdoor device according to claim 3, wherein the base further includes at least one separation portion that spaces one of the plurality of first seats from one of the plurality of second seats.

6. The outdoor device according to claim 5, wherein the base further includes at least one first drain hole from which a liquid guided through the at least one separation portion is discharged.

7. The outdoor device according to claim 1, wherein the heat exchanger surrounds the at least one compressor and the gas-liquid separator.

8. The outdoor device according to claim 1, wherein the at least one compressor includes a first compressor and a second compressor, and wherein the at least one connection portion includes a plurality of connection portions that corresponds to the first and second compressors.

9. The outdoor device according to claim 8, wherein the plurality of connection portions includes:

a first connection portion that connects one first seat to support the first compressor to one second seat; and a second connection portion that connects another first seat to support the second compressor to another second seat.

10. The outdoor device according to claim 1, wherein the at least one second seat includes at least one second drain hole from which a liquid is discharged.

11. The outdoor device according to claim 10, wherein the leg includes a plurality of legs provided on the lower portion of the base where the two first sides are defined, and wherein the at least one second drain hole is defined in the at least one second seat provided on a portion of the base where the two second sides are defined.

12. The outdoor device according to claim 1, wherein the at least one first seat includes a plurality of coupling holes, to which the at least one compressor and the gas-liquid separator are coupled.

13. The outdoor device according to claim 1, wherein the at least one first seat protrudes in the upward direction from the base body.

14. An outdoor device for an air conditioner, the outdoor device comprising:

a plurality of suction panels that defines a front surface, both side surfaces, and a rear surface of the outdoor device, respectively;

a heat exchanger provided inside of the plurality of suction panels and bent to extend along four surfaces of the plurality of suction panels;

a base provided at lower portions of the plurality of suction panels, the base having two first sides corresponding to the front and rear surfaces and two second sides corresponding to the both side surfaces;

a plurality of brackets that is disposed between the plurality of suction panels and extends in an upward direction from the base; and a plurality of legs provided on a lower portion of the base where the two first sides are defined, wherein the base includes:

a base body;

an edge portion provided along a circumference of the base, the edge portion including an edge body having a height higher than a height of the base body;

a step that extends in an upward direction from the base body toward the edge body;

at least one first seat to which at least one compressor and at least one gas-liquid separator are coupled, the at least one first seat being provided on the base body;

at least one second seat that protrudes in the upward direction from the edge body and on which the heat exchanger is provided, wherein the at least one second seat is provided along the two first sides and the two second sides of the base;

at least one connection portion that connects the at least one first seat to the at least one second seat; and at least one drain hole defined in the at least one second seat provided along each of the two second sides to guide drainage of a liquid from the base, and wherein the at least one first seat, the at least one second seat, and the at least one connection portion form one plane.

* * * * *